US008178823B2

(12) United States Patent
Fogle et al.

(10) Patent No.: US 8,178,823 B2
(45) Date of Patent: May 15, 2012

(54) PROTECTIVE WRAP FOR MICROWAVABLE CONTAINER

(75) Inventors: James C. Fogle, Marietta, GA (US); Jean-Manuel Gomes, Marietta, GA (US); Kevin May, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 2522 days.

(21) Appl. No.: 10/874,632

(22) Filed: Jun. 23, 2004

(65) Prior Publication Data

US 2005/0284865 A1 Dec. 29, 2005

(51) Int. Cl.
*H05B 6/80* (2006.01)
*B65D 5/10* (2006.01)

(52) U.S. Cl. ..... 219/734; 219/729; 206/557

(58) Field of Classification Search ..... 219/734, 219/729–730, 759; 426/107, 110, 122; 206/557, 206/216, 526, 769, 784, 485.1, 562, 495; 220/23.89, 62.2, 48, 258.2, 258.5, 259.1, 220/254.3, 245.3

See application file for complete search history.

(56) References Cited

U.S. PATENT DOCUMENTS

| | | | | |
|---|---|---|---|---|
| 2,939,622 | A * | 6/1960 | D Ippolito | 206/485 |
| 3,765,529 | A * | 10/1973 | Mueller | 206/779 |
| 3,893,566 | A * | 7/1975 | Ross | 220/258.2 |
| 4,596,356 | A * | 6/1986 | Chaussadas | 206/486 |
| 4,821,884 | A * | 4/1989 | Griffin et al. | 206/557 |
| 5,012,929 | A * | 5/1991 | Roosa | 229/120.011 |
| 5,522,537 | A * | 6/1996 | Barlow | 229/109 |

* cited by examiner

*Primary Examiner* — Quang Van
(74) *Attorney, Agent, or Firm* — Womble Carlyle Sandridge & Rice, LLP

(57) ABSTRACT

A wrap for a microwavable container, such as a cup with a removable lid, the wrap having a separable hinged portion to allow the lid of the container to be removed. The separable portion can then be returned to its original position, and the wrap and enclosed container heated in a microwave oven. During heating, the wrap remains relatively cool to the touch, so that the wrap and container can be removed from the oven by grasping the wrap, without contacting the hot exterior of the container.

23 Claims, 12 Drawing Sheets

PROTECTIVE WRAP FOR MICROWAVABLE CONTAINER

BACKGROUND OF THE INVENTION

This invention generally relates to a paperboard wrap for a microwavable container, such as a cup with a removable lid. When assembled, the wrap surrounds the container, but is constructed so that a user can remove the lid of the container. The container, positioned in the wrap, can then be heated in a microwave oven, and after heating can be removed from the oven by grasping the wrap, without touching the hot exterior of the container.

At the present time, food and other items which are intended to be heated before consumption are sold in microwavable cups or other containers. These containers are typically made of plastic and have a metal lid or seal covered by a plastic cap. When the user wishes to heat the container, the plastic cap is removed, the metal lid is detached, and the plastic cap is replaced. The container can then be heated in a microwave oven.

One problem that has arisen in the use of these microwavable containers is that the external surface of the container becomes very hot when the container and its contents are heated. If the user attempts to remove the container from the oven by grasping the container directly, contact of the user's fingers with the hot surface may cause burns, inadvertent dropping of the container, or other undesirable consequences.

SUMMARY OF THE INVENTION

It is therefore an object of this invention to provide a wrap for a microwavable container which allows removal of the lid of the container before heating and enables the user to remove the container from a microwave oven after heating without having to grasp the hot exterior surface of the container directly, or without having to use a potholder, oven mitt, or other article to protect the user's hand. It is also an object of the invention to provide a method of heating a microwavable container in such a wrap.

In its preferred form, the present invention achieves its objects by providing a wrap having top, bottom and side walls which are adapted to surround a microwavable container. A portion of the wrap my be separated from the rest of the wrap and pivoted away therefrom about a hinge line, this pivotable portion being so configured that, when opened, the user can access the lid of the container in order to remove it. After the lid is removed, the separable portion of the wrap can be pivoted back to its original position, and the wrap with the enclosed container is heated in a microwave oven. After heating the wrap, together with the heated container, is removed from the oven by grasping the wrap. Since the wrap is made of a material, such as paperboard, which remains relatively cool to the touch, the container and wrap can be removed from the oven without the user contacting the container's hot exterior surface.

An additional advantage of the invention is that it eliminates the necessity for providing a plastic cap on the microwavable container, since the wrap itself covers the open top of the container while it is being heated.

DETAILED DESCRIPTION OF THE INVENTION

Figure 1:
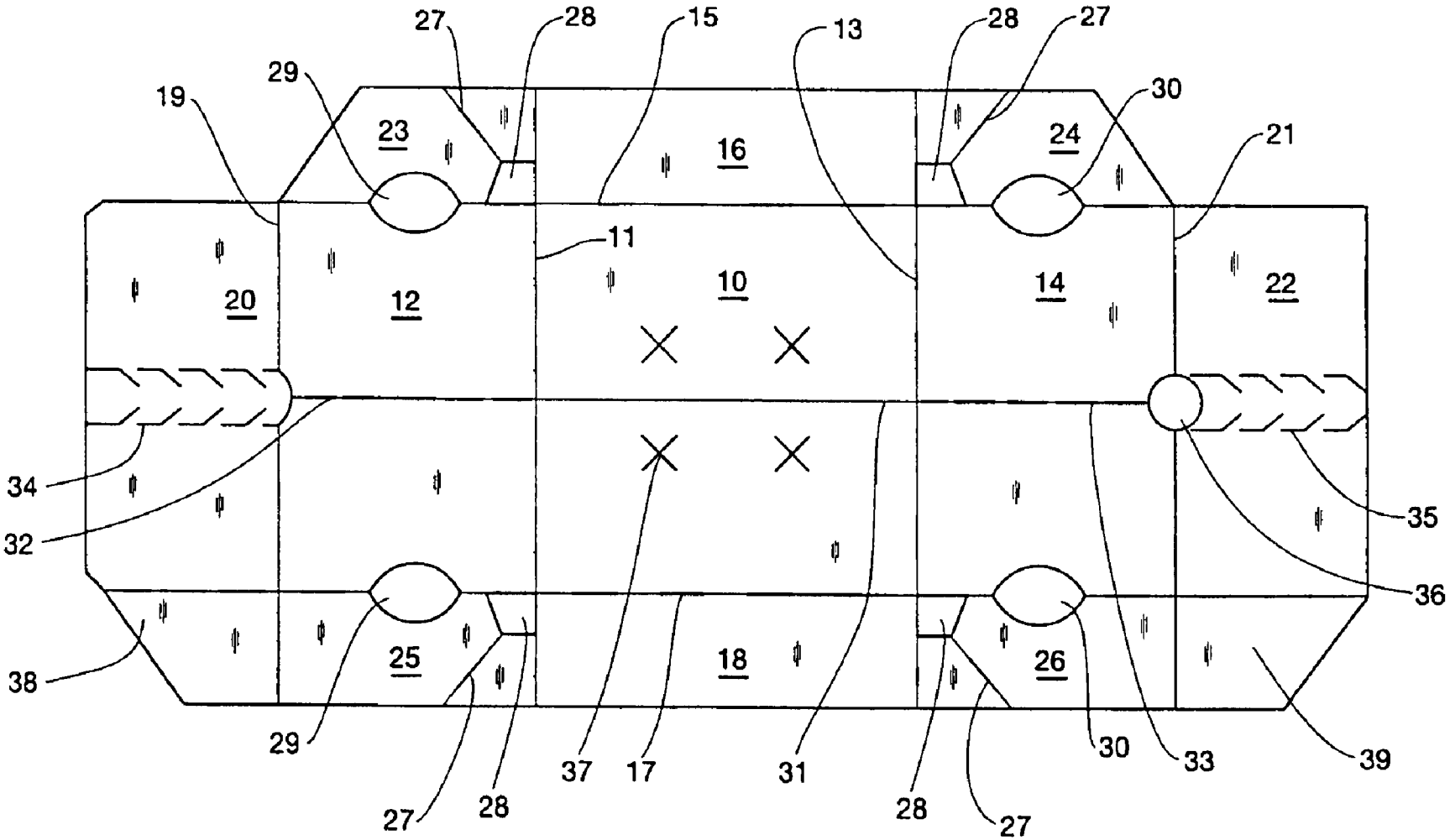
FIG. 1 is a plan view of a blank from which a first embodiment of the wrap of this invention is formed.

A first embodiment of the wrap of the invention is formed from a blank made of a foldable sheet of material, such as paperboard. The blank, shown in FIG. 1, has a top wall 10, which is joined by fold line 11 to side wall 12, by fold line 13 to side wall 14, by fold line 15 to side wall 16, and by fold line 17 to side wall 18. Side wall 12 is joined by fold line 19 to bottom flap 20, and side wall 14 is joined by fold line 21 to bottom flap 22.

As shown in FIG. 1, in the blank for forming the first embodiment of the wrap of the invention, side wall 16 has a gusset 23, 24 at each end. Gusset 23 is joined to side wall 16 by fold line 11, and to side wall 12 by fold line 15, and gusset 24 is joined to side wall 16 by fold line 13, and to side wall 14 by fold line 13. Gussets 23, 24 taper down at their outside edges to meet the ends of fold lines 19, 21 respectively. Side wall 18 has a gusset 25, 26 at each end, gusset 25 being joined to side wall 18 by fold line 11 and to side wall 12 by fold line 17, and gusset 26 being joined to side wall 18 by fold line 13, and to side wall 14 by fold line 17. Gussets 25, 26 extend to the free ends of bottom flaps 20, 22, respectively. Each of gussets 23, 24, 25, 26 has a fold line 27 which extends at an angle from an aperture 28 to the outside edge of the gusset. Openings 29 are provided on fold lines 15 and 17 at the junctions of side wall 12 with gussets 23 and 25, and openings 30 are provided on fold lines 15 and 17 at the junctions of side wall 14 with gussets 24 and 26, for a purpose to be described.

A hinge line 31 extends across the center of the top wall 10 between fold lines 11 and 13. Aligned with hinge line 31, tear lines 32, 33 extend across the center of side walls 12, 14, respectively, and tear strips 34, 35 extend across the center of bottom flaps 20, 22, respectively. An aperture 36 is provided at the intersection of fold line 21 and tear strip 35.

A number of vents 37 (four are shown in FIG. 1), in the form of X-shaped cuts, may be provided in top wall 10 to permit the exit of steam when the microwavable container is heated.

In order to form the blank of FIG. 1 into a wrap for a microwavable container with a removable lid, the top of the container is positioned against the inside of the top wall 10 and the side walls 12, 14, 16 and 18 are folded over the sides of the container about fold lines 11, 13, 15 and 17, respectively. At the same time, gusset 23 is tucked into the wrap about fold lines 11 and 15; gusset 24 is tucked into the wrap about fold lines 13 and 15; gusset 25 is tucked into the wrap about fold lines 11 and 17; and gusset 26 is tucked into the wrap about fold lines 13 and 17. While being tucked into the wrap, each of gussets 23, 24, 25 and 26 also folds about its fold line 27. Bottom flap 20 is folded about fold line 19 over the bottom of the container and is glued to bottom flap 22, which is folded about fold line 21, to form a bottom wall, while gussets 25, 26 are folded about fold lines 19, 21, respectively, so that their outer portions 38, 39 lie against the inside of the bottom wall. With the bottom flaps 20, 22 glued together, tear strips 34, 35 form a continuous tear strip across the bottom wall of the wrap (see FIG. 3).

Figure 2:
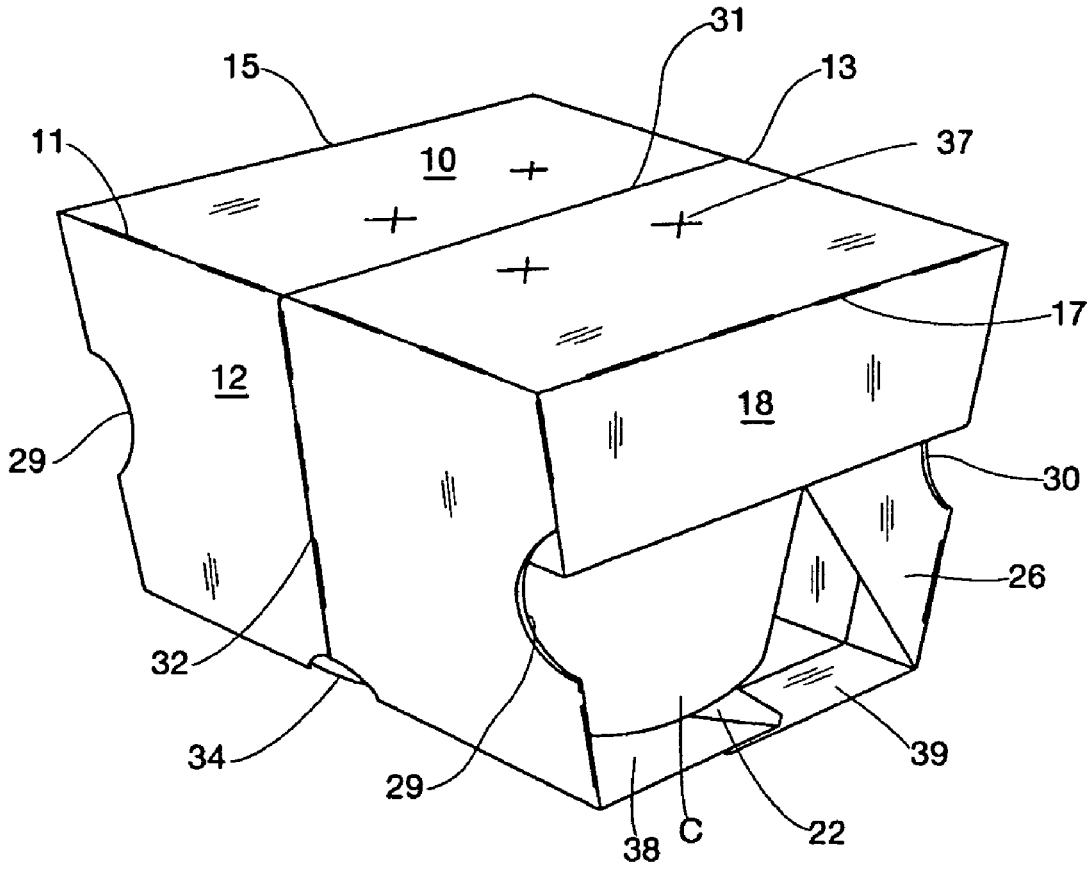
FIG. 2 is a perspective view of the wrap formed from the blank of FIG. 1, containing a microwavable container.

As shown in FIG. 2, the assembled wrap surrounds the microwavable container C, which is here shown as a cup with a circular horizontal cross-section, to retain the container in the wrap until it is to be used. However, since side walls 16, 18 are shorter than the adjacent side walls 12, 14, side walls 16, 18 do not extend from the top wall 10 to the bottom wall of the wrap, but form lips depending from the opposite edges of top, wall 10. The spaces between the bottom edges of the lips and the edges of the bottom wall allow the container to be observed from the outside of the wrap.

Figure 4:
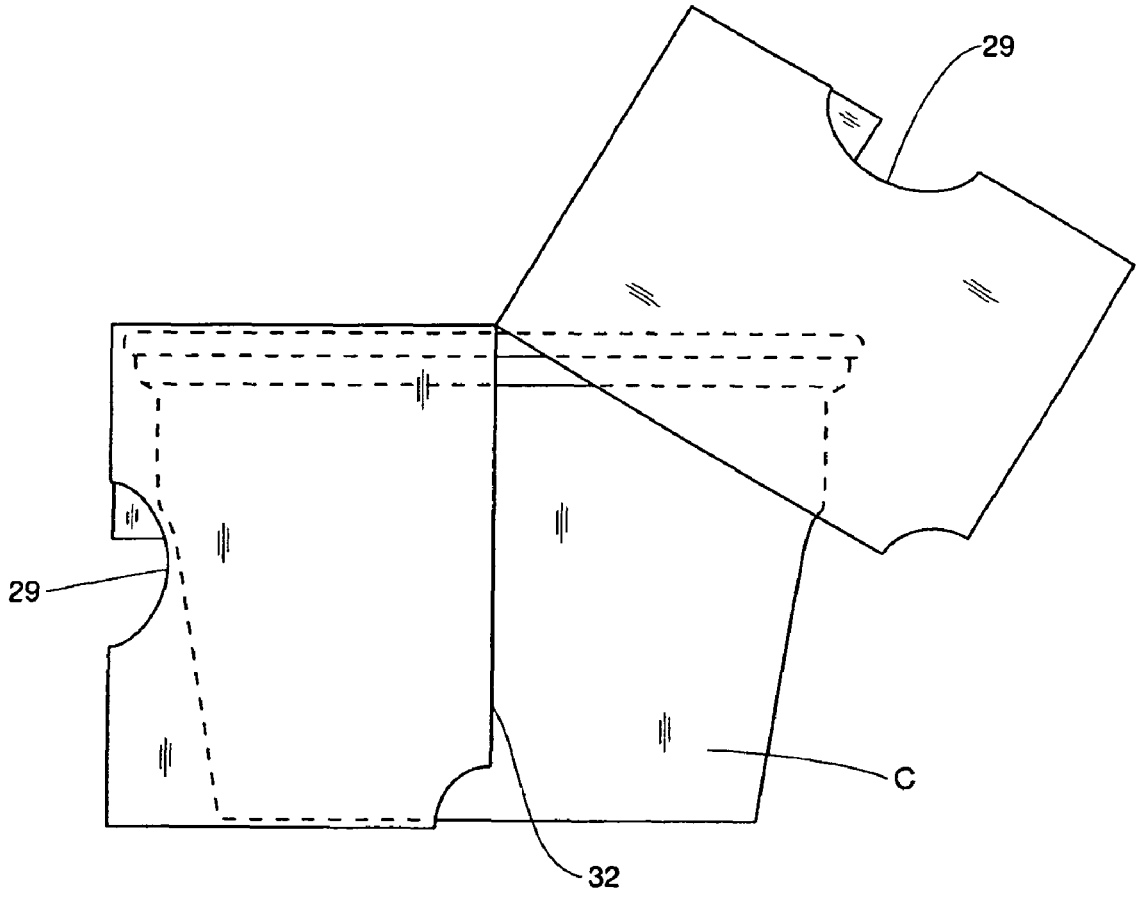
FIG. 4 is a side view of the wrap of FIG. 2, with one half of the wrap separated and pivoted upward.

When a user wishes to heat the container and its contents, he/she inserts a finger into the aperture 36 and removes the tear strip 34, 35. The wrap can then be divided on a vertical plane along tear lines 32, 33 and one half of the wrap pivoted upwardly relative to the other half about hinge line 31 in the top wall 10, as shown in FIG. 4. This allows the user to access the container C by pulling it out of the wrap sufficiently to remove the metal lid, which typically is provided with a pull tab. After the lid is removed, the container is pushed back into the wrap and the half of the wrap is pivoted back down to its original position. Because the wrap is dimensioned to closely surround the container, the two halves of the wrap are held in position around the container by frictional engagement between the wrap and the outside of the container.

The wrap and enclosed container can then be placed in a microwave oven and heated sufficiently to heat the contents of the container. After heating the user grasps the sidewalls 12, 14 of the wrap and removes the wrap and container from the oven. Since the outside of the container becomes very hot while the paperboard material of the wrap remains relatively cool to the touch, the user can remove the container from the oven without touching the container's hot surface. The container can then be removed from the wrap, the wrap discarded, and the contents of the container consumed.

Figure 3:
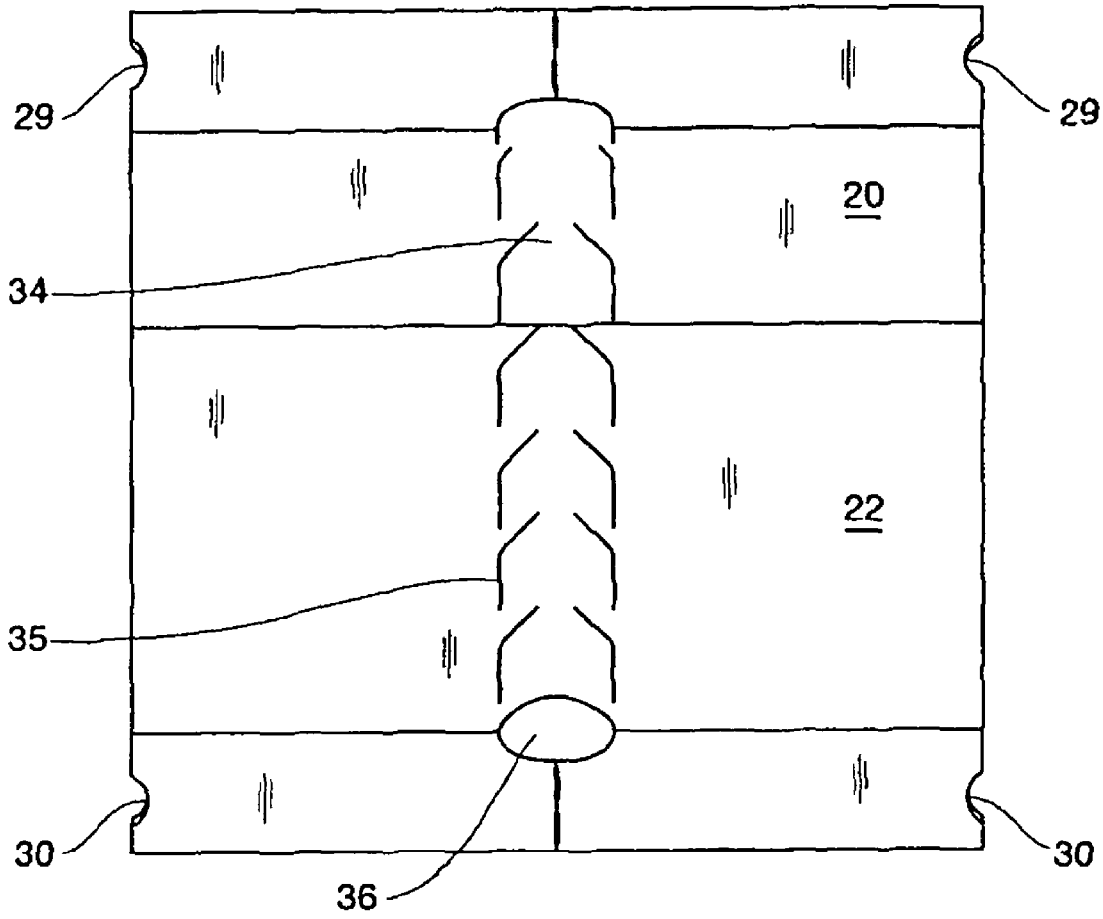
FIG. 3 is a bottom view of the wrap of FIG. 2.
Figure 5:
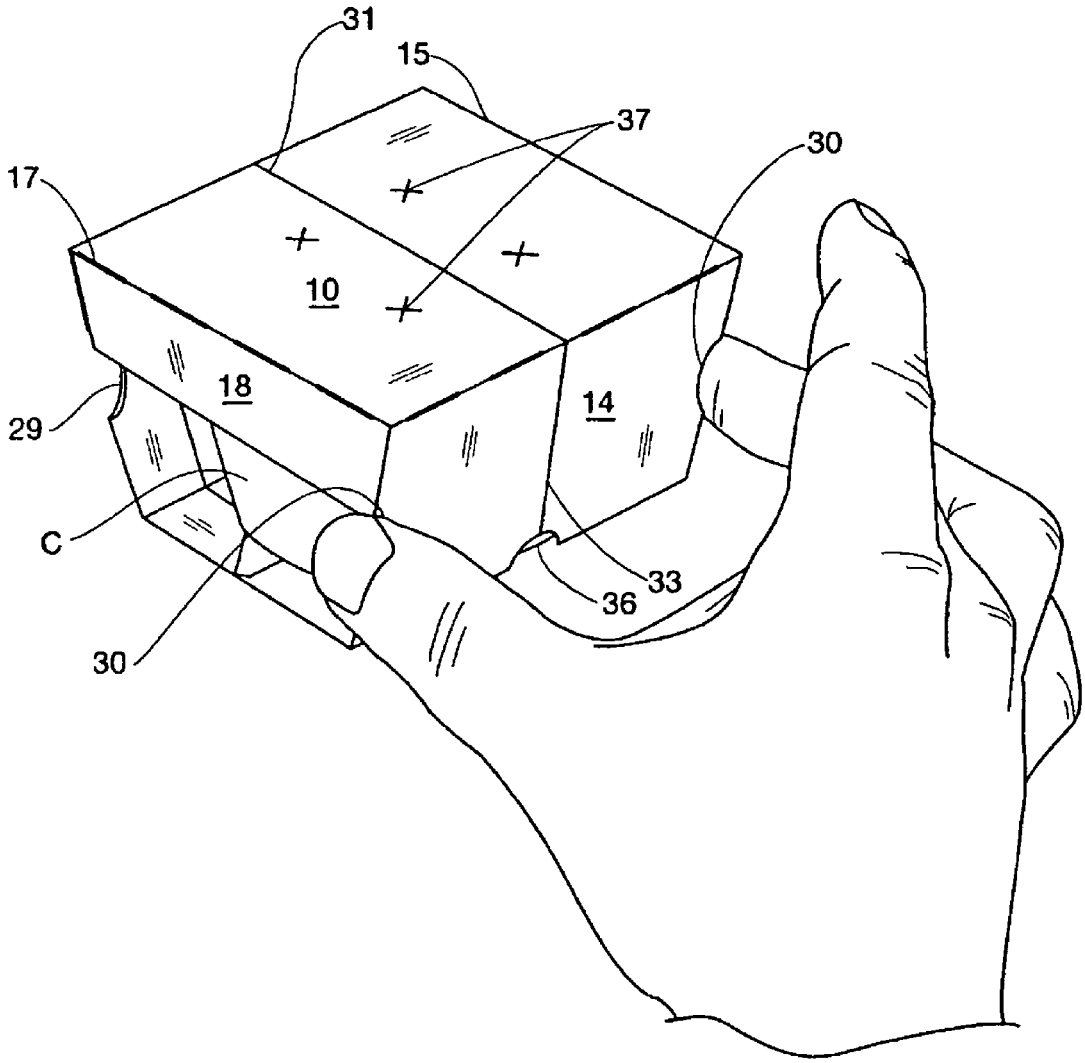
FIG. 5 is a perspective view of the wrap of FIG. 2 gripped by a user for placement into or removal from a microwave oven.

As shown in FIGS. 2 and 3, when the gussets 23, 24, 25 and 26 are tucked into the wrap, the openings 29, 30 are folded in half to form cutouts at the vertical edges of side walls 12 and 14. These cutouts provide locations at which the wrap can be easily grasped by the user's fingers, as illustrated in FIG. 5, and the pressure of the fingers at these points tends to squeeze the two halves of the wrap together, helping to keep them in position around the container as the wrap is placed into and removed from the oven.

Figure 6:
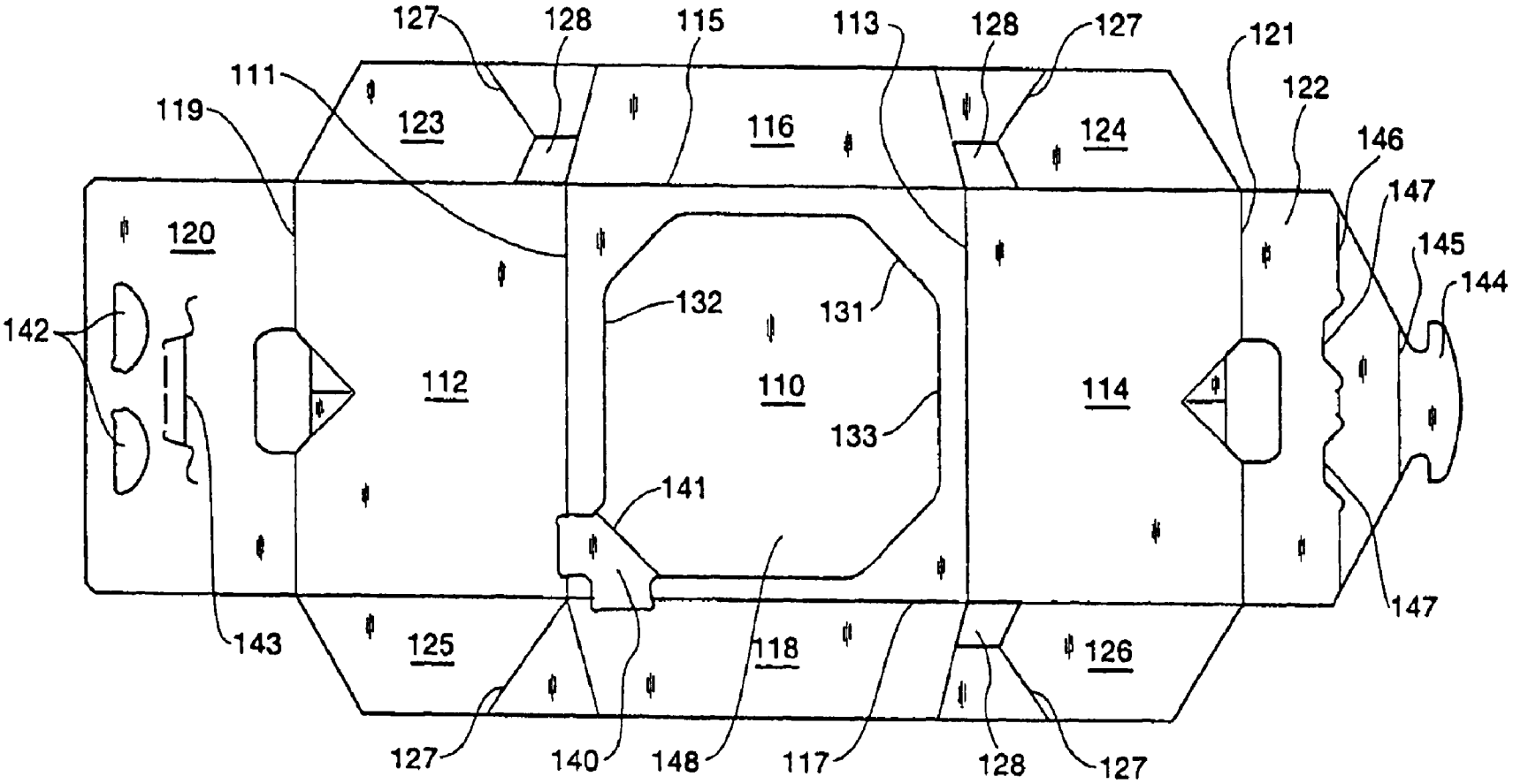
FIG. 6 is a plan view of a blank from which a second embodiment of the wrap of this invention is formed.

A second embodiment of the wrap of the invention is formed from the blank shown in FIG. 6. This blank has a top wall 110 which is joined by fold line 111 to side wall 112, by fold line 113 to side wall 114, by fold line 115 to side wall 116, and by fold line 117 to side wall 118. Side wall 112 is joined by fold line 119 to bottom flap 120, and side wall 114 is joined by fold line 121 to bottom flap 122.

As shown in FIG. 6, in the blank for forming the second embodiment of the wrap of the invention, side wall 116 has a gusset 123, 124 at each end, gusset 123 being joined to side wall 116 by fold line 111, and to side wall 112 by fold line 115, and gusset 124 being joined to side wall 116 by fold line 113, and to side wall 114 by fold line 113. Side wall 118 has a gusset 125, 126 at each end, gusset 125 being joined to side wall 118 by fold line 111 and to side wall 112 by fold line 117, and gusset 126 being joined to side wall 118 by fold line 113, and to side wall 114 by fold line 117. Gussets 123 and 125 extend to the free ends of fold line 119 and gussets 124 and 126 extend to the free ends of fold line 121. Each of gussets 123, 124, 125, 126 has a fold line 127 which extends at an angle across to the outside edge of the gusset. Apertures 128 are provided in gussets 123, 124 and 126.

A hinge line 131 extends across one corner of the top wall 110. Tear lines 132, 133 extend from either end of the hinge line 131 around the periphery of the top wall to a tab 140 formed at the opposite corner of the top wall 110. The tab has two cutout ears which extend just beyond the fold lines 111, 117 and is separated from the area between the tear lines 132, 133 by a fold line 141. The hinge line 131, tear lines 132, 133, and hinge line 141 are so located that the area defined between them constitutes a lid 148 which is pivotable about hinge line 131 and will permit a user to access and remove the lid of a microwavable container within the wrap.

Bottom flap 120 contains two substantially semicircular slots 142, and a longitudinal slot 143, defined by a cut and a tear line, located closer to fold line 119 than slots 142. Bottom flap 122 has a T-shaped locking tab 144 at its outer free end, separated from the remainder of the flap by fold line 145, and a second fold line 146, parallel to and between fold lines 121 and 146, in which are cuts defining two tabs 147.

Figure 8:
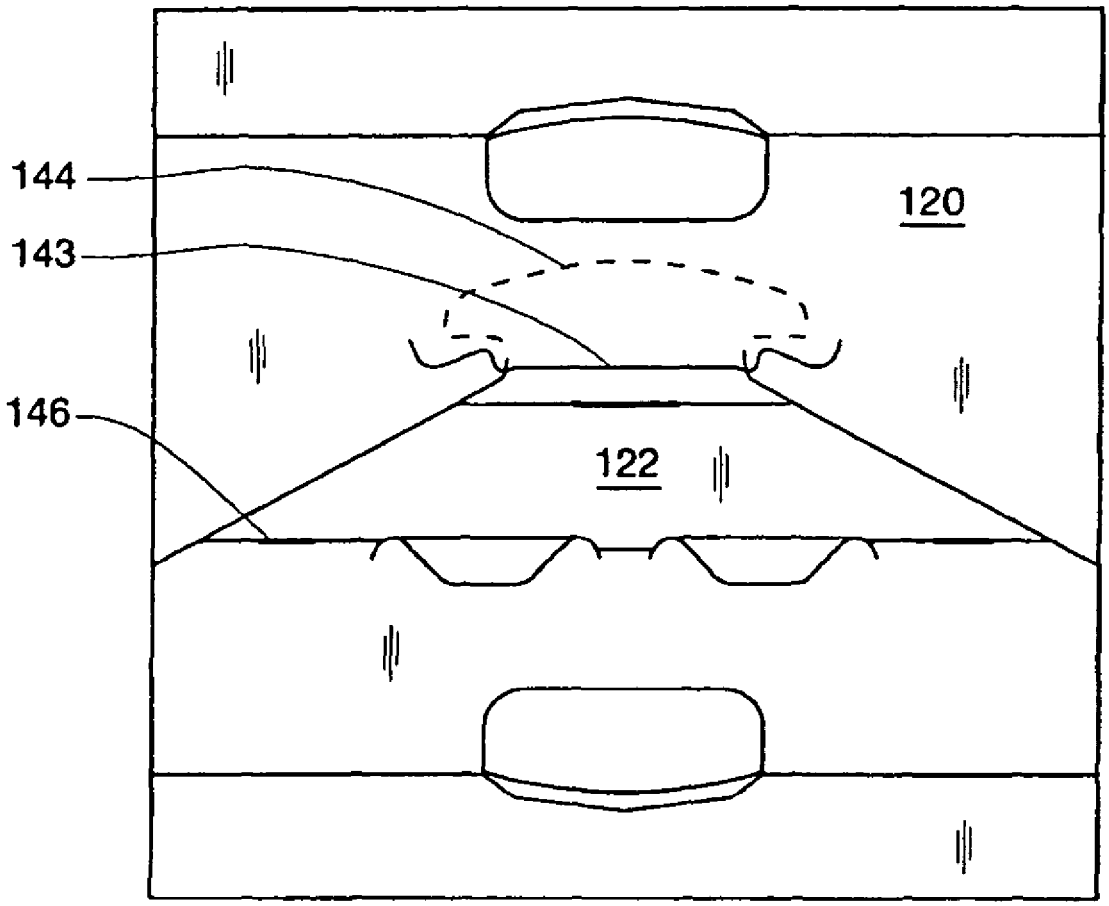
FIG. 8 is a bottom view of the wrap of FIG. 7.

In order to form the blank of FIG. 6 into a wrap for a microwavable container with a removable lid, the top of the container is positioned against the inside of the top wall 110, and side walls 112, 114, 116 and 118 are folded over the sides of the container about fold lines 111, 113, 115 and 117, respectively. At the same time, gusset 123 is tucked into the wrap about fold lines 111 and 115; gusset 124 is tucked into the wrap about fold lines 113 and 115; gusset 125 is tucked into the wrap about fold lines 111 and 117; and gusset 126 is tucked into the wrap about fold lines 113 and 117. While being tucked into the wrap, each of gussets 123, 124, 125 and 126 also folds about its fold line 127. Bottom flap 120 is folded about fold line 119 over the bottom of the container, and bottom flap 121 is folded about fold line 121. The T-shaped locking tab 144 on bottom flap 122 engages slot 143 on bottom flap 120, and the tabs 147 on bottom flap 120 engage slots 142 on bottom flap 120, thereby attaching the bottom flaps together to form a bottom wall, as shown in FIG. 8.

As with the first embodiment of the invention, the assembled wrap shown in FIG. 7 surrounds the microwavable container C, but since side walls 116, 118 form lips depending from the opposite edges of top wall 110, the container can be observed from outside the wrap through the spaces below side walls 116, 118.

Figure 9:
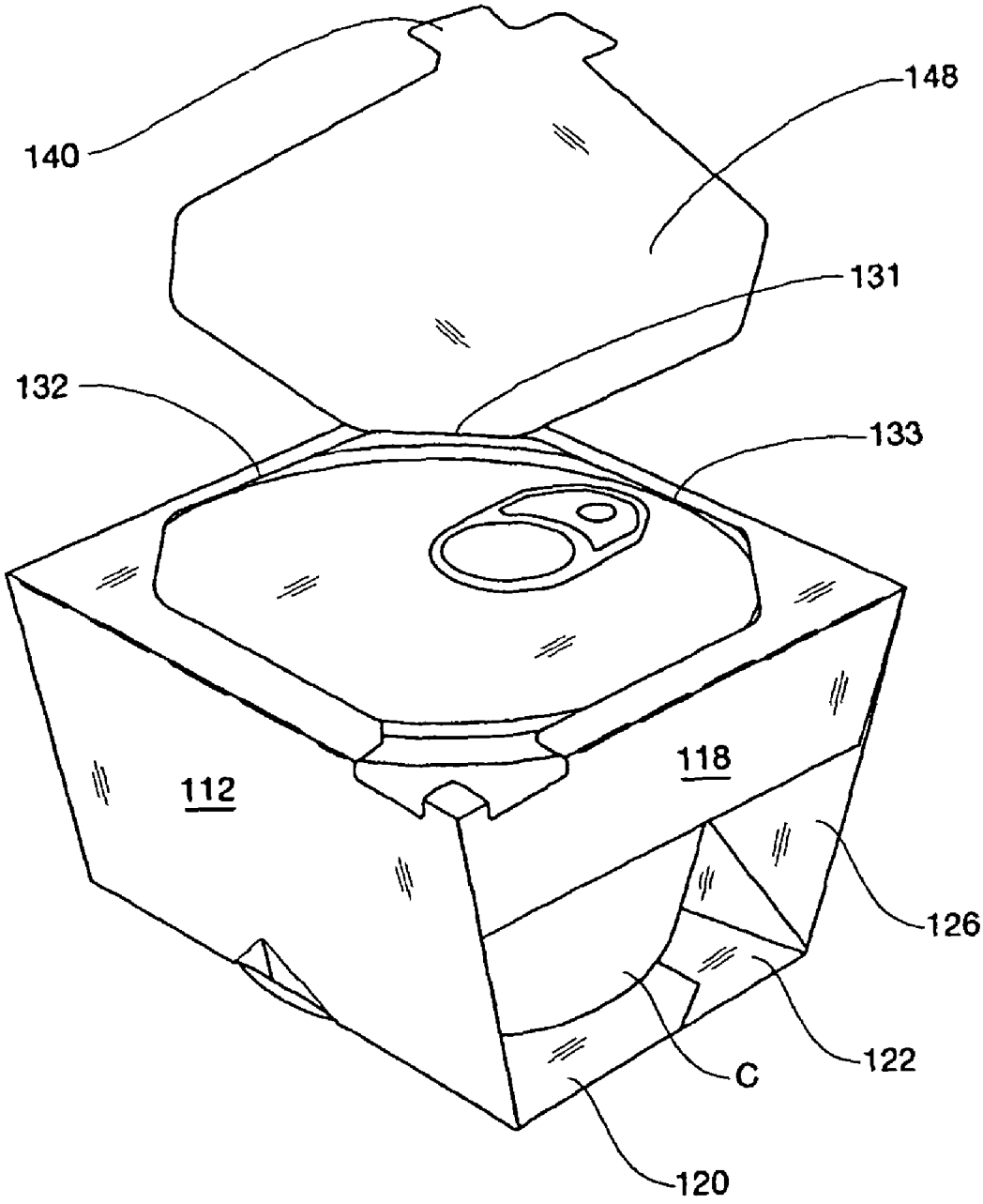
FIG. 9 is a perspective view of the wrap of FIG. 7, with the lid of the wrap separated and pivoted upward.

When a user wishes to heat the container and its contents, he/she pulls tab 140 upward, separating lid 148 from the remainder of the top wall 110 along tear lines 132, 133 and pivoting it upwardly about hinge line 131. The top of the microwavable container C can then be accessed to remove its lid, as shown in FIG. 9. Lid 148 is then pivoted back down to its original position and is retained in its original position by the ears on tab 140, which engage the aperture or slot formed in the top wall 110 by the area vacated by the tab.

The wrap and enclosed container can then be heated in a microwave oven as described with regard to the first embodiment of the wrap of the invention. However, the container does not have to be removed from the second embodiment of the wrap before its contents are consumed, but rather the user can simply disengage the tab 140, raise the lid 148, and consume the contents. This offers the advantage that the user can consume the contents immediately after the container and wrap are removed from the oven, instead of having to wait for the container to cool sufficiently to allow it to be removed from the wrap.

Figure 10:
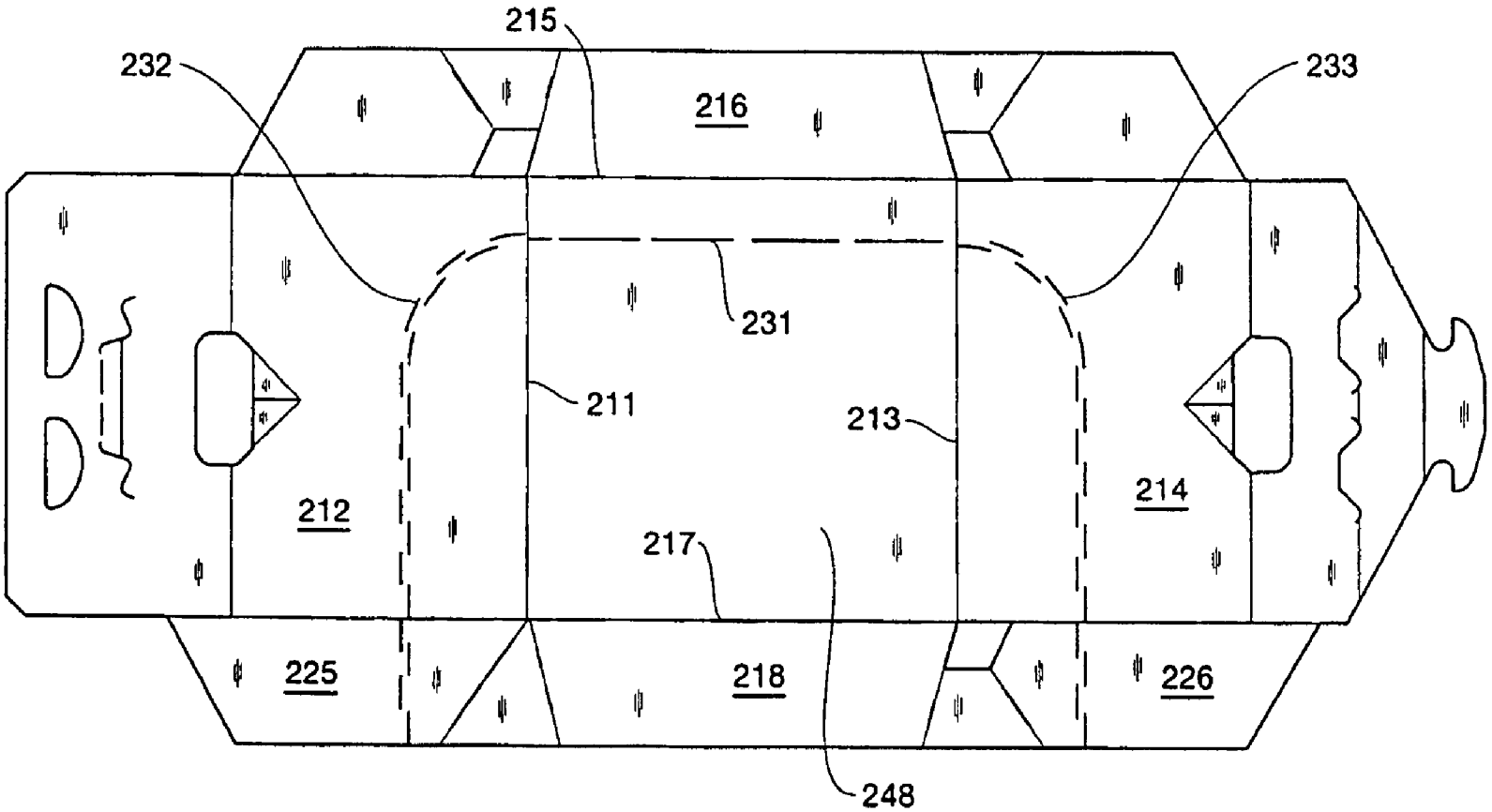
FIG. 10 is a plan view of a blank from which a third embodiment of the wrap of this invention is formed.

A third embodiment of the wrap of the invention is formed from the blank shown in FIG. 10. This blank is basically the same as the blank shown in FIG. 6, except for the location of the hinge line and tear lines.

Figure 11:
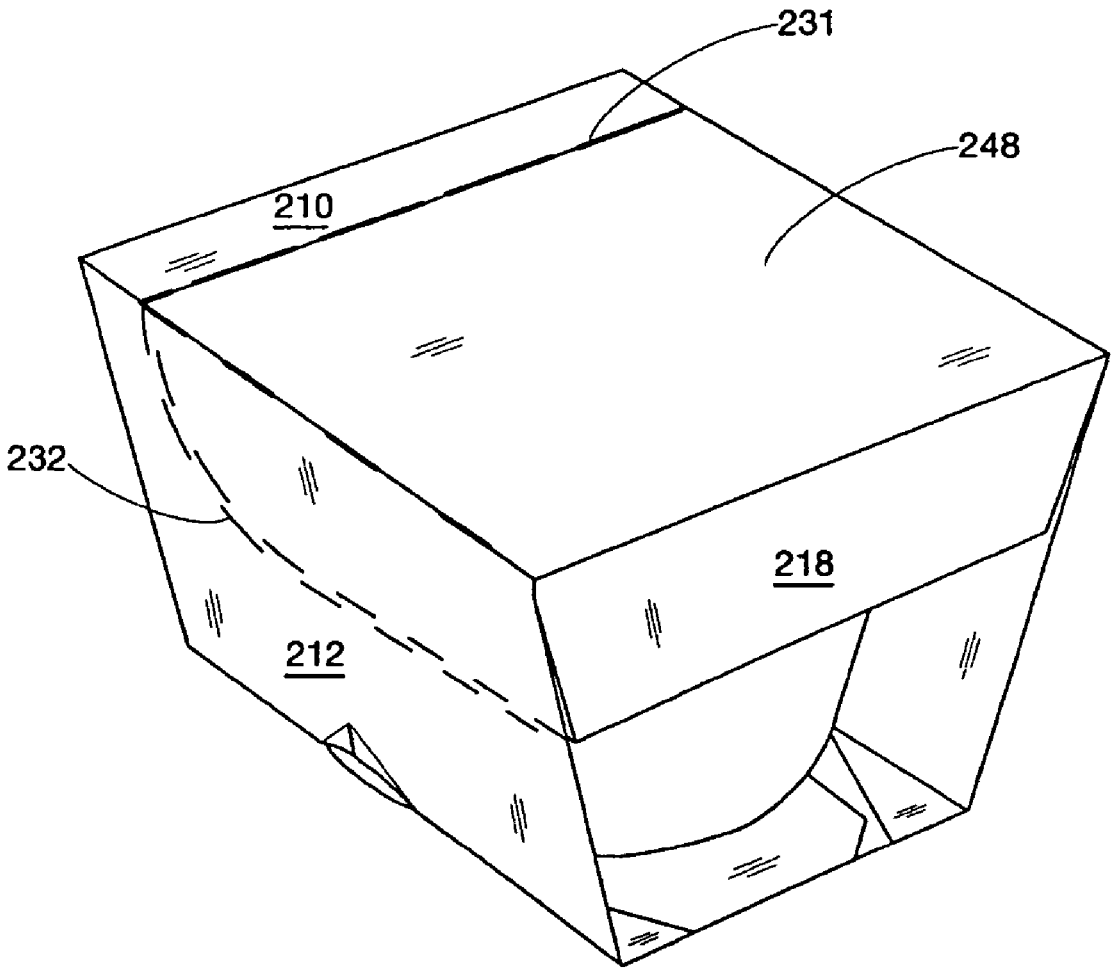
FIG. 11 is a perspective view of the wrap formed from the blank of FIG. 10, containing a microwavable container.
Figure 12:
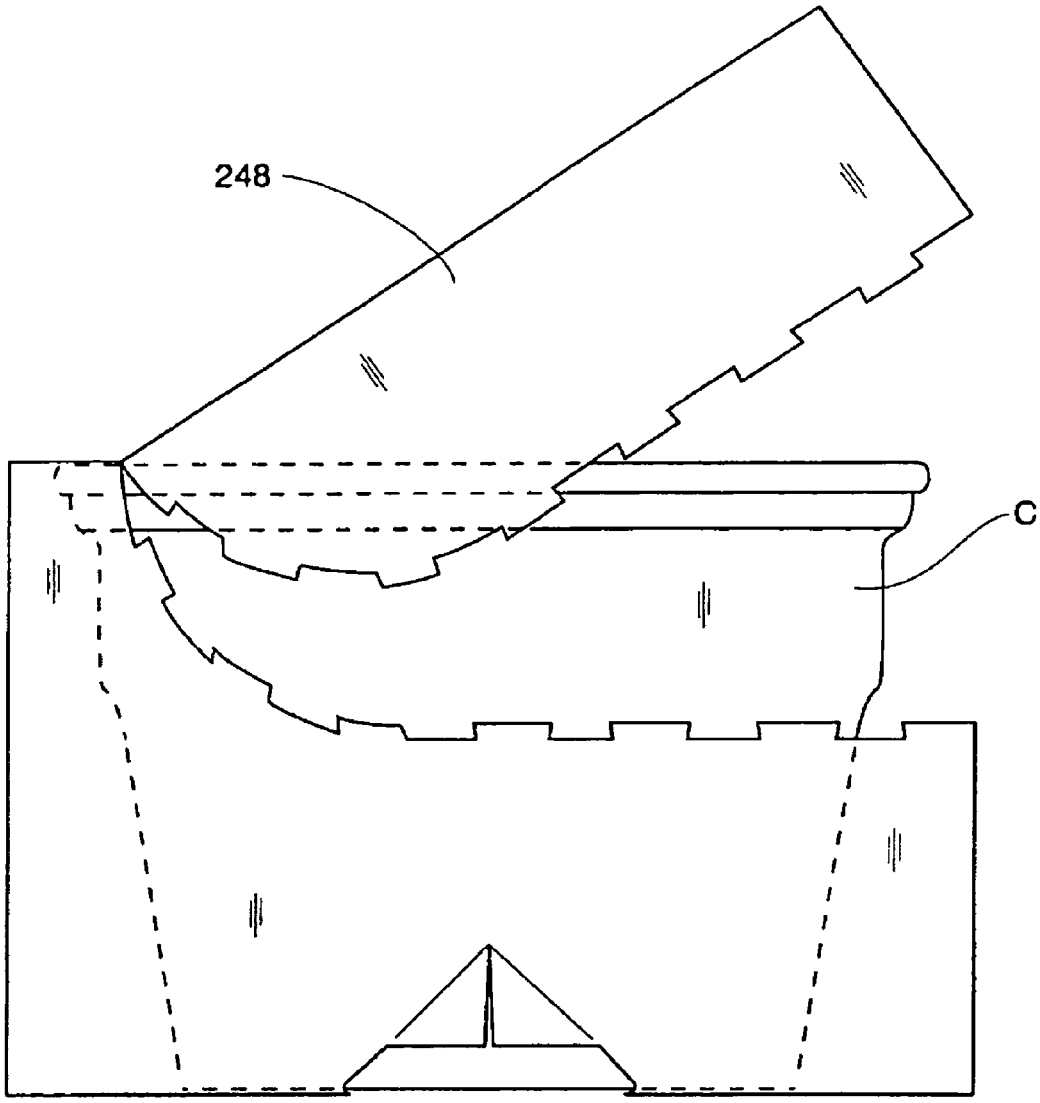
FIG. 12 is a side view of the wrap of FIG. 11, with the lid of the wrap separated and pivoted upward.

In the blank of FIG. 10, the hinge line 231 is located in top wall adjacent and parallel to fold line 215, and extends between fold lines 211 and 213. From the junction of hinge line 231 and fold line 211, a tear line 232 extends across side wall 212, away from fold line 211, and then parallel to it and across gusset 225 to the outer edge of the blank. Likewise, tear line 233 extends from the junction of hinge line 231 and fold line 213 across side wall 214, away from fold line 213, and then parallel to it and across gusset 226 to the outer edge of the blank. Preferably, the distance between tear line 232 and fold line 211, the distance between tear line 233 and fold line 213, and the width of side wall 218 between fold line 217 and outer edge of the blank, are all approximately equal. Hinge line 231 and tear lines 232, 233 are so located relative to the other elements of the blank that the area defined between them constitutes a lid 248 which can be pivoted about hinge line 231 and will permit a user to access and remove the lid of a microwavable container within the wrap. As shown in FIGS. 10 to 12, lid 248 consists of the portion of top wall 210 between hinge line 231 and fold line 217, with side wall 218 depending from its front edge, and the areas between fold line 211 and tear line 232, and between fold line 213 and tear line 233, depending from its opposite side edges.

The blank of FIG. 10 is formed into a wrap for a microwavable container in the same manner as described above with regard to the blank of FIG. 6.

When a user wishes to heat the container and its contents, he/she separates the lid 248 from the remainder of the wrap along tear lines 232, 233, and pivots it upward about hinge line 231. The lid is then removed from the microwavable container, the lid 248 is pivoted back down to its original position, and the wrap with the enclosed container is placed in the oven for heating. As with the other embodiments of the wrap of the invention, the wrap and container can be removed from the oven after heating by grasping the relatively cool wrap, avoiding contact with the hot exterior of the container. After a suitable interval, the container can be removed from the wrap and its contents consumed.

While the tear lines have been shown in the drawings as a series of slits, they may constitute perforations or any other arrangement which will facilitate separation along a predetermined line. Also, although it is preferred that the bottom flaps of the embodiments of FIGS. 7 and 11 be attached together with the disclosed arrangement of co-engaging tabs and slots, they could be attached by means of gluing if desired.

The top wall 10, 110 or 210 of the disclosed embodiments is shown as being square, to accommodate a container which has a circular horizontal cross section, but it could be rectangular or otherwise shaped, depending on the shape of the container to be contained.

Figure 7:
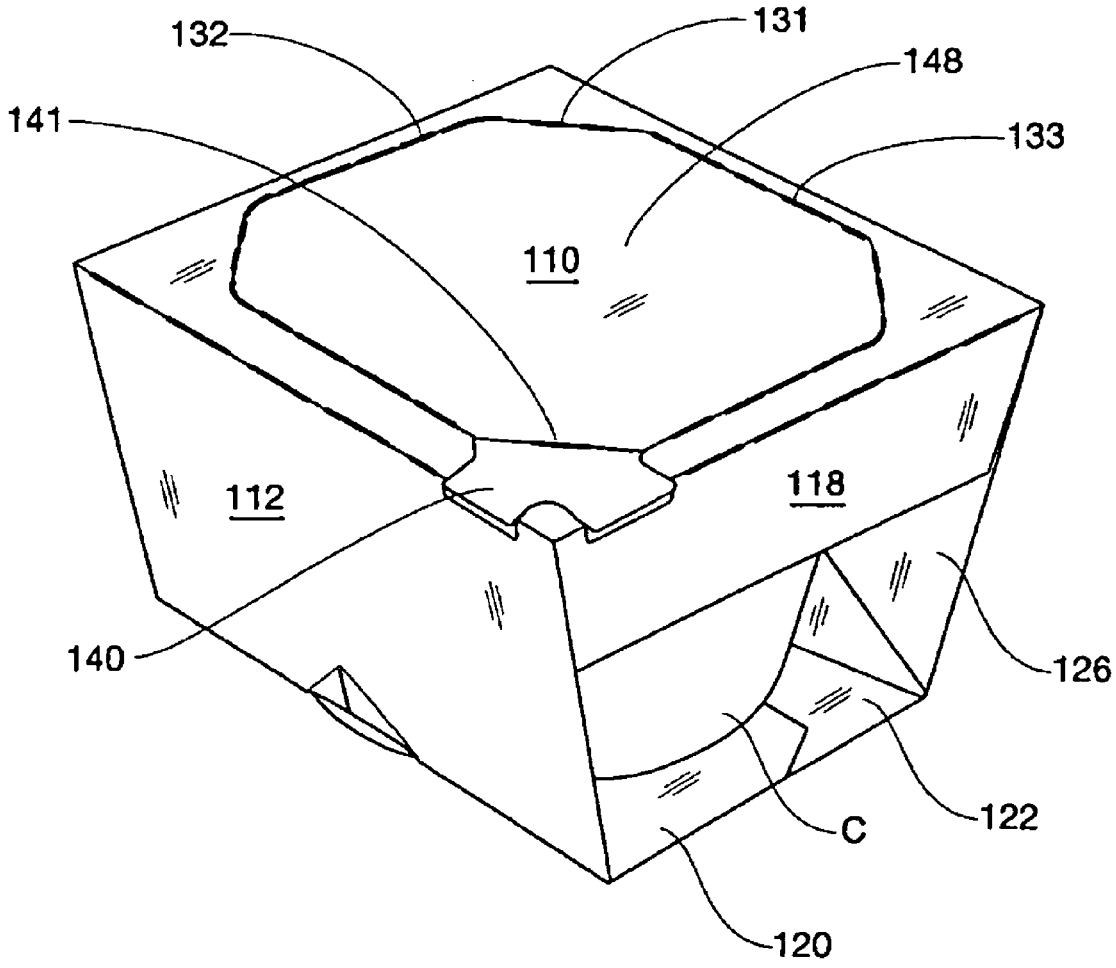
FIG. 7 is a perspective view of the wrap formed from the blank of FIG. 6, containing a microwavable container.

Optionally, the lid 148 of the embodiment of FIG. 7 and the lid 248 of the embodiment of FIG. 11 may be provided with vents similar to the vents 37 shown in top wall 10 of the embodiment of FIG. 2.

In each of the disclosed embodiments of the wrap of this invention, the shorter side walls, i.e., side walls 16 and 18 of FIG. 1, 116 and 118 of FIG. 6, and 216 and 218 of FIG. 10, are substantially parallel to each other and perpendicular to the top wall. This allows the wraps to be stored on their sides, which is advantageous in that they will occupy less shelf space. Also, with this arrangement graphic material printed on the top wall can be displayed by facing the top wall toward the customer.

We claim:

1. A protective wrap for a microwavable container having a removable lid, the wrap comprising:

a top wall, a bottom wall, and side walls adapted to surround the container;

the wrap including a remainder portion and a separable portion separable from the remainder portion and pivotable away from the remainder portion about a hinge line formed in the top wall; the remainder portion including a section of the top wall and the searable portion including sections of at least two of the side walls;

the separable portion being so located that when it is pivoted away from the remainder portion, the lid of the container is accessible for removal;

whereby, after the lid of the container has been removed, the separable portion may be pivoted back to its initial position with the container positioned within the wrap.

2. The wrap of claim 1, wherein the hinge line approximately bisects the top wall.

3. The wrap of claim 2, wherein the separable portion is separable from the remainder of the wrap along a tear line.

4. The wrap of claim 3, wherein the tear line extends across a first side wall from the junction of the top wall and the first side wall to the bottom wall, across the bottom wall, and from the bottom wall across a second side wall to the junction of the top wall and the second side wall, opposite the first side wall.

5. The wrap of claim 4, wherein cutouts are located at the side corners of the wrap, to facilitate grasping of the wrap.

6. The wrap of claim 3, wherein the tear line is located entirely within the top wall.

7. The wrap of claim 3, wherein a first side wall comprises a lip extending from one edge of the top wall, and a tear line extends across each of the adjacent side walls from their junction with the top wall to a point adjacent to the bottom edge of the lip.

8. The wrap of claim 1, wherein the separable portion comprises a section of the wrap divided on a vertical plane, the hinge line extending across the top wall to allow the separable portion to be pivoted upwardly about the hinge line.

9. The wrap of claim 1, wherein the separable portion is a pivotable lid comprising approximately half a of the top wall.

10. The wrap of claim 9, wherein the hinge line extends across a corner of the top wall to allow the pivotable lid to be pivoted upwardly about the hinge line.

11. The wrap of claim 9, wherein the pivotable lid is formed by sections of the top wall and side walls, the pivotable lid having a lip on each of its free edges, the hinge line extending entirely across the top wall to allow the pivotable lid to be pivoted upwardly by about the hinge line.

12. The wrap of claim 1, including means for retaining the separable portion in its initial position after the lid of the container has been removed.

13. The wrap of claim 12, wherein the means for retaining comprises frictional engagement between the separable portion and the container.

14. The wrap of claim 12, wherein the means for retaining comprises an inter-engageable tab and slot.

15. The wrap of claim 1, wherein the bottom wall comprises two flaps, and means for attaching the two flaps together.

16. The wrap of claim 15, wherein the means for attaching comprises glue.

17. The wrap of claim 15, wherein the means for attaching comprises at least one co-engageable tab and slot.

18. The wrap of claim 15, wherein the means for attaching comprises two tabs on one flap, a locking tab at the free end of that flap, and slots in the other flap engageable with the two tabs and the locking tab.

19. The wrap of claim 1 having four side walls, two of the opposing side walls comprising lips which depend from the edge of the top wall.

20. The wrap of claim 19, wherein the container is a cup having a circular horizontal cross section, and the top wall is a square.

21. The wrap of claim 1, having at least one vent in the top wall to permit the escape of steam from the container when heated.

22. The wrap of claim 1, wherein the wrap is made of a material which will remain substantially cooler to the touch than the exterior of the container when the wrap and container are heated together in a microwave oven.

23. The wrap of claim 22, wherein the wrap is made of paperboard.

* * * * *